US006935135B1

(12) United States Patent
Brady et al.

(10) Patent No.: US 6,935,135 B1
(45) Date of Patent: Aug. 30, 2005

(54) BEADED FASHION ACCESSORIES FOR USE ON THE BODY

(76) Inventors: Andrea R. Brady, 121 Bradford Dr., Milford, OH (US) 45150; Cornelius F. Leary, 1172 Waycross Rd. Apt. B203, Cincinnati, OH (US) 45240

( * ) Notice: Subject to any disclaimer, the term of this patent is extended or adjusted under 35 U.S.C. 154(b) by 0 days.

(21) Appl. No.: 09/849,383

(22) Filed: May 5, 2001

Related U.S. Application Data

(60) Provisional application No. 60/269,069, filed on Feb. 14, 2001.

(51) Int. Cl.[7] ..... A44C 7/00
(52) U.S. Cl. ..... 63/14.9; 63/DIG. 1
(58) Field of Search ..... 63/12, 14.1, 14.9, 63/DIG. 1

(56) References Cited

U.S. PATENT DOCUMENTS

| | | | | |
|---|---|---|---|---|
| 4,220,016 | A * | 9/1980 | Frenger | 63/14.9 |
| 4,562,704 | A * | 1/1986 | Benedek et al. | 24/616 |
| 4,718,252 | A * | 1/1988 | Fossas | 63/38 |
| 5,018,250 | A * | 5/1991 | Schroder | 24/116 A |
| 5,081,853 | A * | 1/1992 | Salyer | 428/40.1 |
| 5,219,624 | A * | 6/1993 | Kiapos et al. | 24/116 A |
| 5,232,752 | A * | 8/1993 | Crespi et al. | 156/312 |
| 5,233,845 | A * | 8/1993 | D'Andrade | 446/385 |
| 5,279,132 | A * | 1/1994 | Swaim | 63/1.18 |
| 5,497,636 | A * | 3/1996 | Felcher | 24/370 |
| 5,590,546 | A * | 1/1997 | Hector | 63/38 |
| 5,638,701 | A * | 6/1997 | Dempsey | 63/12 |
| 5,669,242 | A * | 9/1997 | Cayton | 24/299 |
| 5,722,260 | A * | 3/1998 | Mangano | 24/71 J |
| 5,848,981 | A * | 12/1998 | Herbranson | 601/134 |
| 5,946,728 | A * | 9/1999 | Tane | 132/273 |
| 6,030,408 | A * | 2/2000 | Kramer | 606/189 |
| 6,378,334 | B1 * | 4/2002 | Hector | 63/26 |
| 6,397,857 | B2 * | 6/2002 | Neary | 132/200 |
| 6,472,039 | B1 * | 10/2002 | Amen-Ra A | 428/42.1 |

OTHER PUBLICATIONS www.yougottahaveit.com, Jan. 7, 2001.*
Bindi's by www.timidtattos.com, Nov. 28, 1999.*

* cited by examiner

*Primary Examiner*—William L. Miller
(74) *Attorney, Agent, or Firm*—Carol D. Titus; Leary & Associates

(57) ABSTRACT

A beaded fashion accessory designed in a variety of lengths, such as 1", 2", 6", 12" and 18". The beads may be strung on a thread or string in a straight line, or a combination of straight lines or woven into a pattern. They are then applied to the body in a variety of ways as a fashion statement. They are held in place with temporary adhesive. The beaded accessory can be used on any part of the body, such as, but not limited to, the eyelids, cheeks, face, chest, arms, legs, torso, buttocks, etc. of the user. An alternate version of invention may include webbed designs or appliqués that may be fabric, beaded, woven, or other patterned pieces that are applied to the skin with a removable adhesive.

13 Claims, 8 Drawing Sheets

BEADED FASHION ACCESSORIES FOR USE ON THE BODY

CROSS-REFERENCE TO OTHER APPLICATIONS

This application claims the benefit of U.S. Provisional Application No. 60/269,069, filed Feb. 14, 2001.

FIELD OF THE INVENTION

The present invention relates to a fashion accessory. In particular, it relates to beaded or appliqué fashion accessories that can be affixed to any part of the body via adhesive.

BACKGROUND OF THE INVENTION

Fashion is always changing, with people always looking for new and interesting ways to differentiate their appearance. New approaches in jewelry, make-up and clothing have typically been the innovations seen throughout the years. New colors and materials, make-up sparkles, and interesting clothing textures are constantly being introduced.

SUMMARY OF THE INVENTION

The present invention is a beaded or appliqué fashion accessory. The accessory can come in a variety of lengths and sizes, such as, but not limited to, 1", 2", 6", 12" and 18", or any fraction thereof. They can be strung on a thread or string in a straight line, as a combination of straight lines (i.e., two strands which meet at either end) or woven into a pattern. They are then applied to the body in a variety of ways as a fashion statement. They are held in place with non-toxic adhesive. For example, the 1" strand beaded accessory can be affixed on the eyelid, just above the eyelashes, where eyeliner is usually drawn; the 6" strand of beads can be affixed over the eyelid in the same place, with the extra length curling into a spiral over the temple; and the 12" or 18" strand of beads can be affixed over the eyelid, then drawn back into the person's hairstyle. The woven pattern can be used to cover more of the body. For example, a woven piece may be used as a "glove" on the back of the hand extending up the arm. The beaded accessory can also be used on the cheeks, chest, neck, arms, legs, etc., affixed with the adhesive, wherever the person wishes to accessorize.

An alternate version of the invention may include appliqués that may be fabric, beaded, woven, or other patterned pieces that are applied to the skin with a removable adhesive.

DETAILED DESCRIPTION OF THE INVENTION

Figure 1:
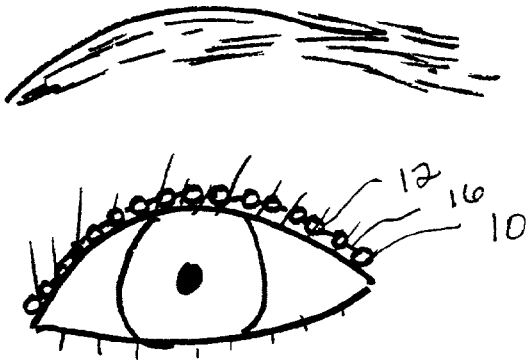
FIG. 1 is a close up view of the beaded accessory worn on the eyelid of the user.
Figure 2:
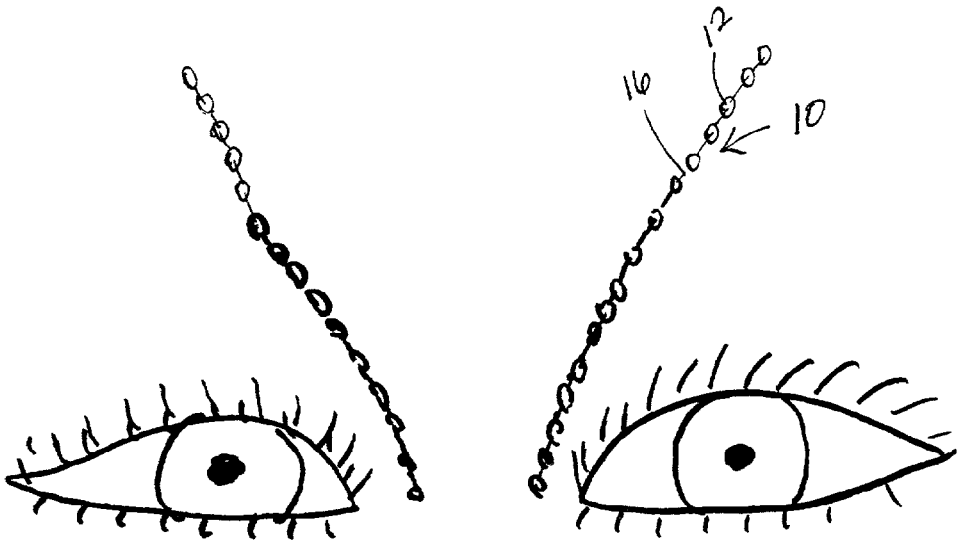
FIG. 2 is a close up view of the beaded accessory worn around the eyes of the user.
Figure 3:
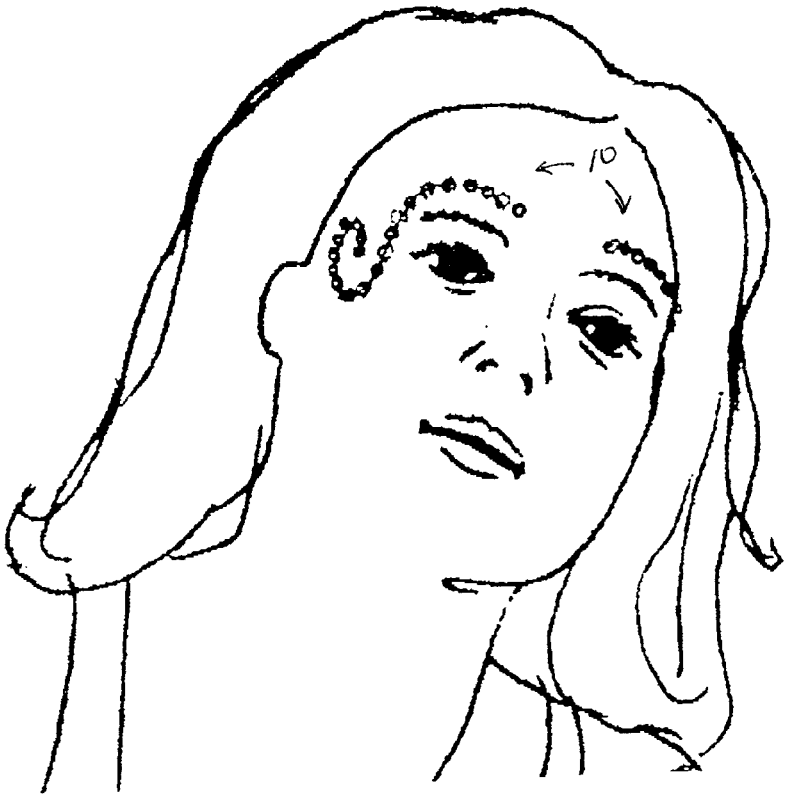
FIG. 3 is a side view of a user wearing the beaded accessory around the eyes of the user.
Figure 4:
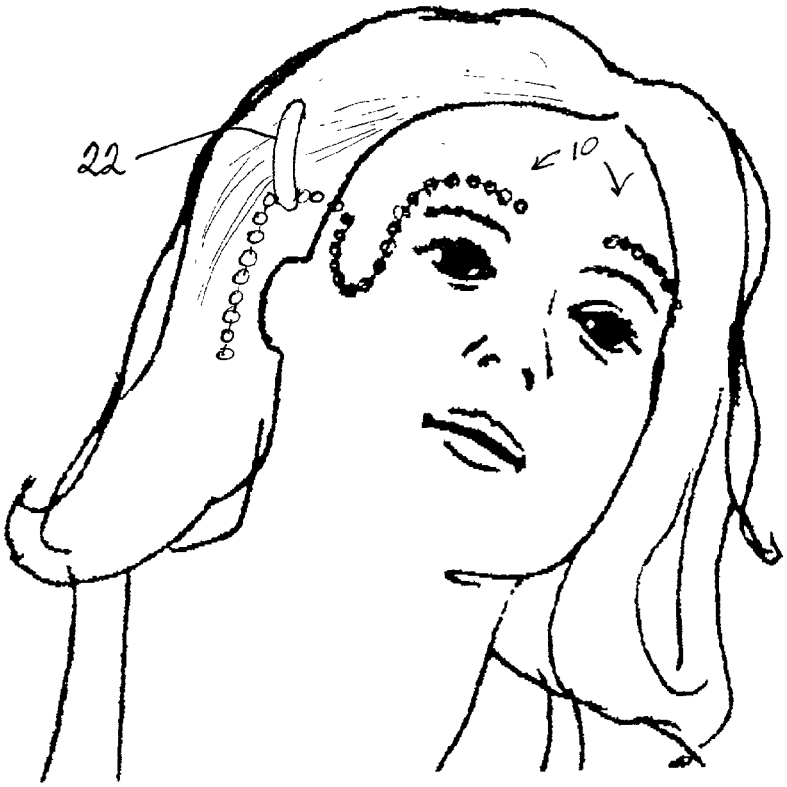
FIG. 4 is a side view a user wearing the beaded accessory around the eyes of the user with one end attached to a barrette.
Figure 5:
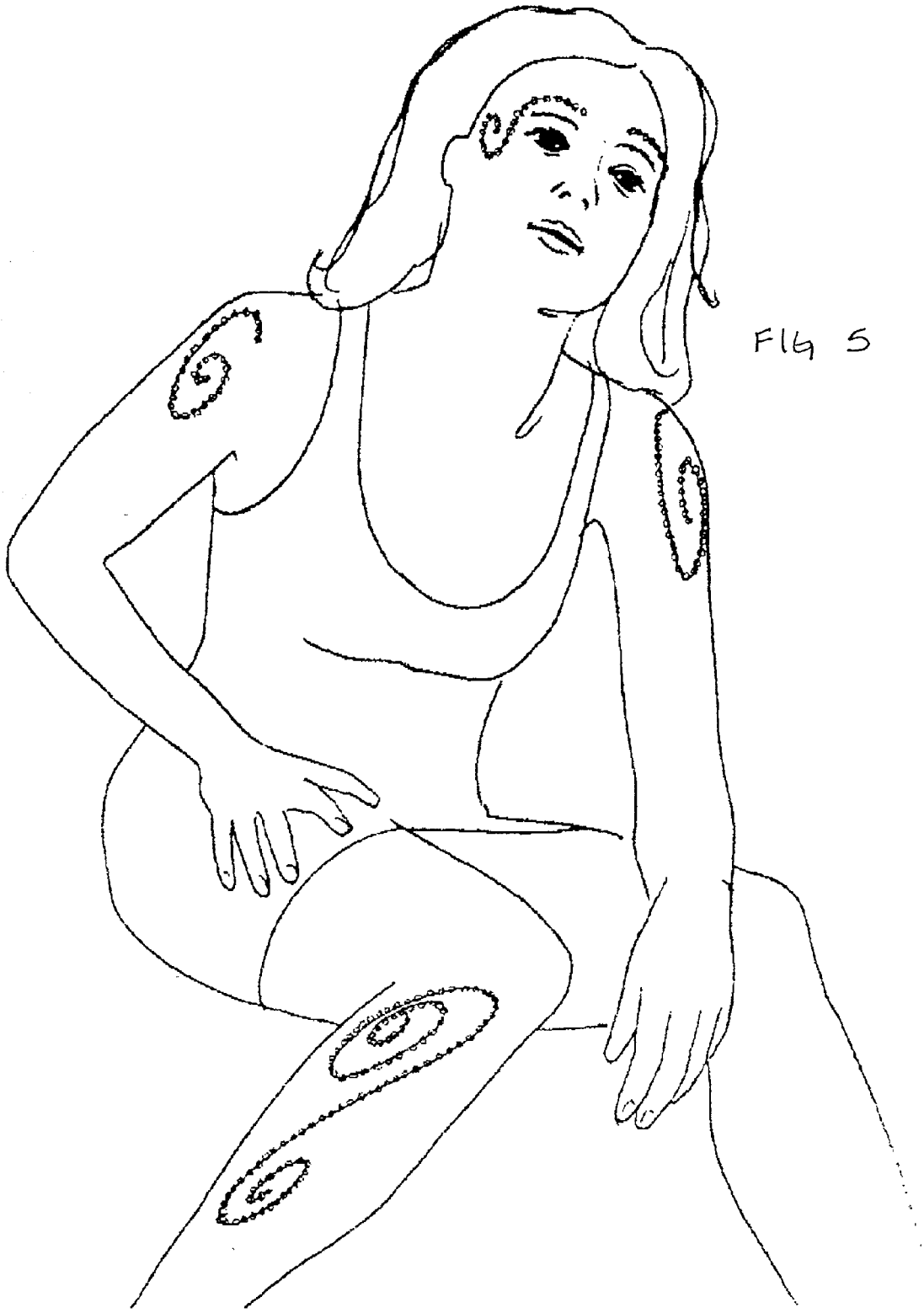
FIG. 5 is a view of a user wearing the beaded accessory on her arms and leg.
Figure 7:
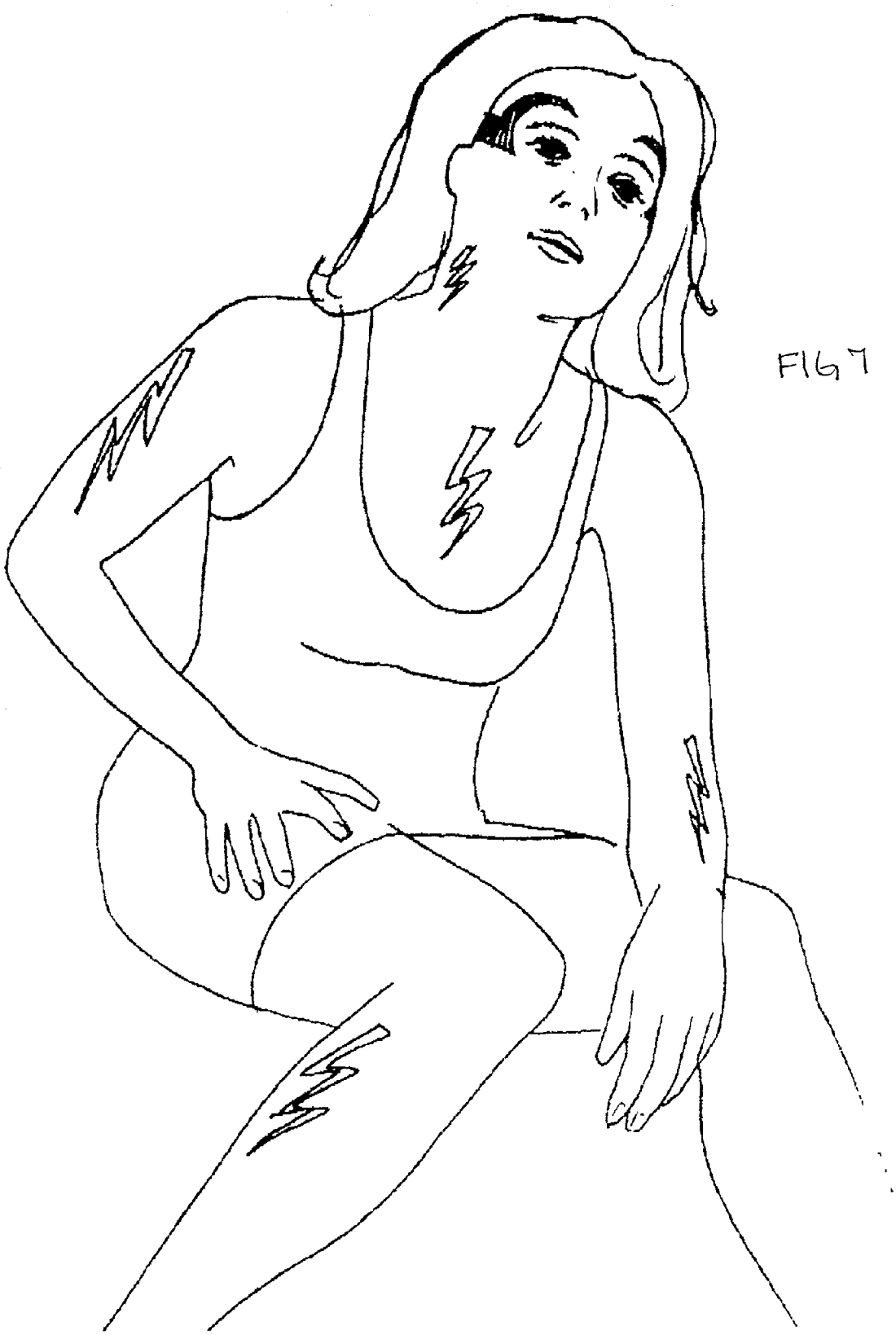
FIG. 7 is an appliqué version of the accessory worn on a user's arms, leg, chest, neck and face.
Figure 8:
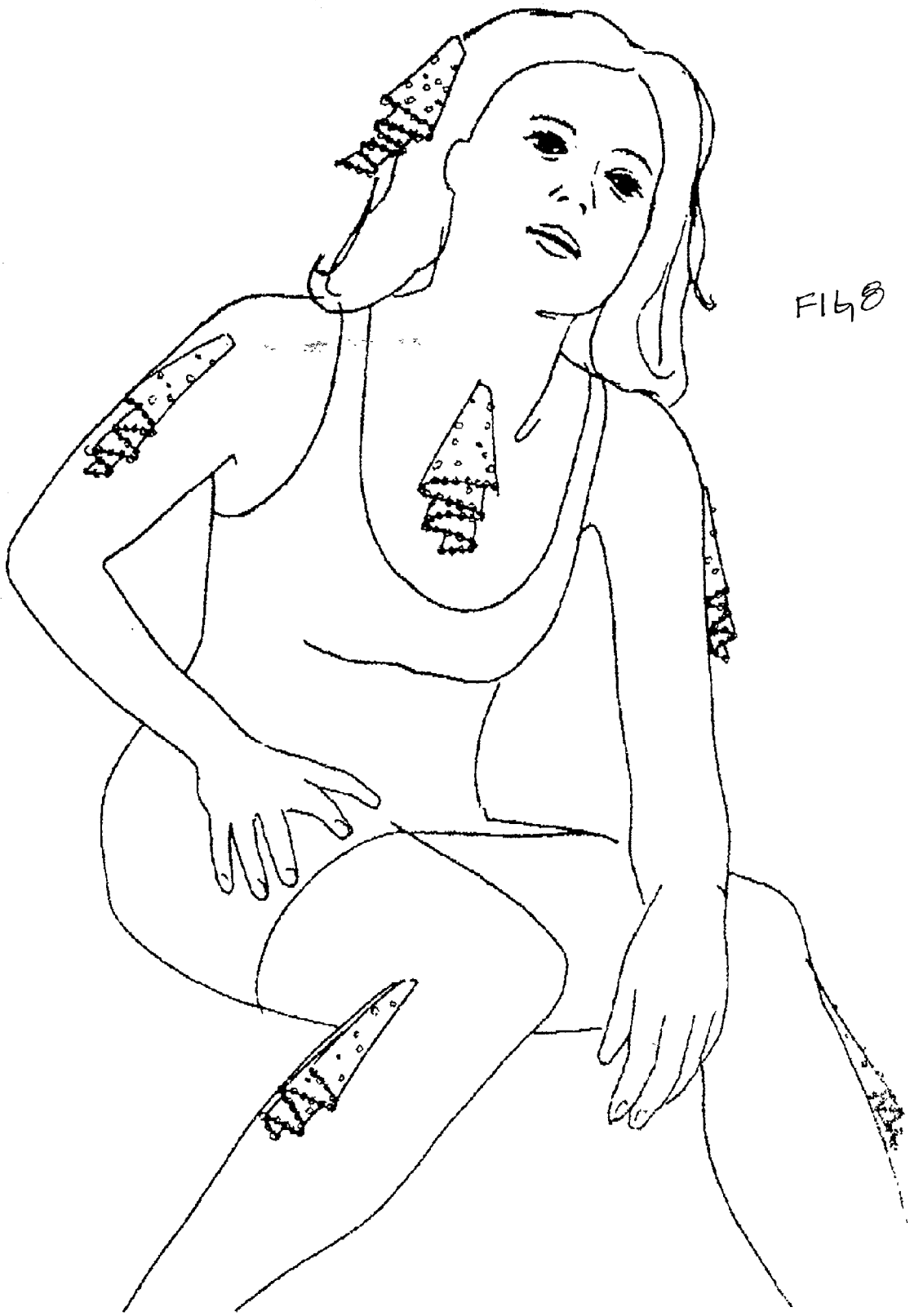
FIG. 8 is another appliqué version of the accessory worn by a user.
Figure 9:
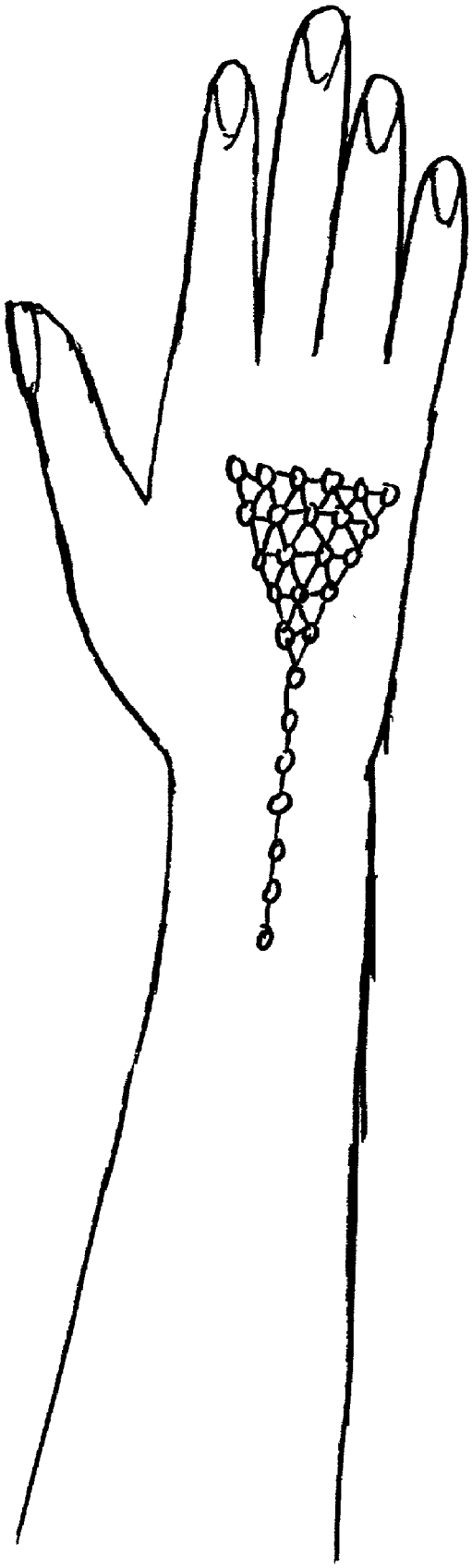
FIG. 9 is a view of an embodiment of the beaded accessory with several strand of beads woven together to formed a webbed design.
Figure 10:
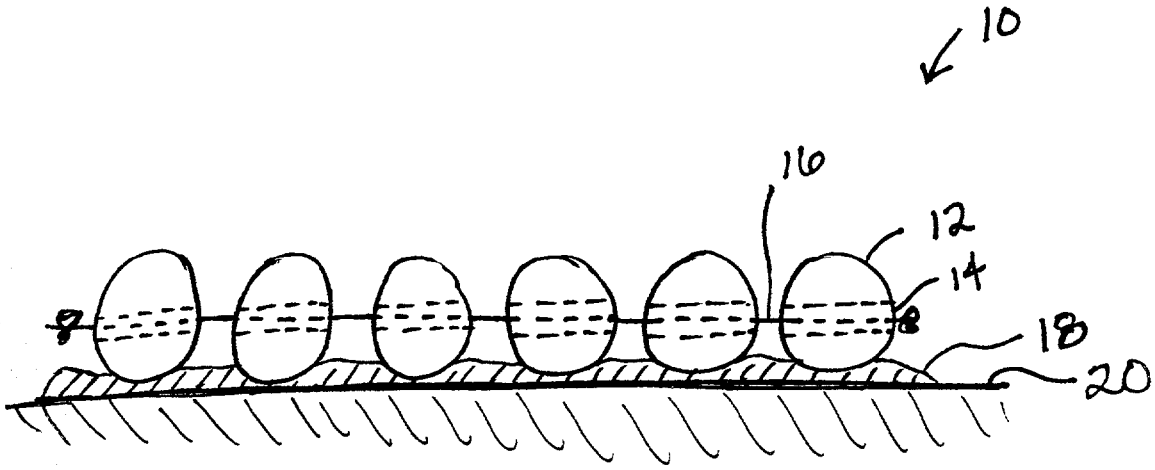
FIG. 10 is a close up detail view showing the beaded accessory adhered to skin.

FIG. 1 is a close up view of a one-inch strand of the beaded accessory 10 worn on the eyelid of the user similar to the location a user might place eyeliner. FIG. 2 is a close up view of a two two-inch strands of the beaded accessory 10 worn between the eyes of the user. FIG. 3 is a side view of a user wearing a six-inch embodiment of the beaded accessory 10 around the eye and temple area. FIG. 4 is a side view of a twelve-inch or eighteen-inch embodiment of the accessory 10 worn by a user around the eye and with one end attached to a barrette 22. FIGS. 5–9 are views of a user wearing the beaded accessory 10 on her arms, legs, chest, neck and face. FIG. 9 is a view of an embodiment of the beaded accessory with several strands of beads 10 integrated together to form a webbed design. FIG. 10 shows a close up of the adhesive 18 adhering the beads 12 to the skin 20.

There are three main parts of the beaded fashion accessory 10: beads 12, string or wire 16 and adhesive 18. The beads 12 form the main decorative portion of the accessory 10. The string or wire 16 is used to hold the beads 12 in a pattern and may also form a decorative element. The adhesive 18 is used to hold the beads 12 and string 16 in place on the skin 20 of the user.

The beaded accessory 10 can be made using any sort of bead 12 of any material or color. For example, the beads may round, semi-spherical, faceted, flat, animal shaped, regular, irregular, representational or non-representational. The beads may be formed of plastic, glass, precious stones, gems or any other suitable material. Beads 12 can be any size, but between 1–5 millimeters is recommended. Beads can be any color, and can be strung in all one color, or multi-color strings. If the beads 12 have holes 14 extending therethrough, the string 16 passes through the holes 14. Alternately, the beads may be adhered to the string, wire or other material 16 prior to application to the skin.

The beads 12 are attached to string, wire or fabric 16. The string 16 may be non-stretchy or stretchy material, such as cloth, plastic or any other suitable material. The string 16 is preferably a long-lasting string that is unlikely to break. Depending on the desired look, the string 16 may be knotted between each of the beads 12 or the beads 12 may be strung resting against one another. The beads 12 may alternately be strung onto a wire formed of a rigid or semi-rigid material formed into a pre-selected shape or a malleable material that the user could form into a desired shape.

The adhesive 18 is a temporary adhesive that is non-toxic. It may also be beneficial to use an adhesive that is hypoallergenic, easy to remove and/or water-resistant. Some options of suitable adhesive 18 include BODY GLUE sold by BeautiControl Cosmetics, Inc. containing purified water, panthenol, PVP, polyvinyl alcohol, methylparaben and diazolidinyl urea. BODY GLUE is designed to hold clothing and accessories in place. Polymethyl-alkylether based adhesives such as those used with adhesive bras or artificial breasts adhesive may be used. Other adhesive options include a vegetable-based adhesive containing dicyandiamide and carbamide urea, latex based adhesives (such as false eyelash adhesives). Other potential adhesives would be clear tape, such as is used for medical purposes, which can be placed in spots to hold longer strands and allow them to move in-between adhesive points. Once the beaded accessory 10 is affixed to a user's body, the adhesive strips are virtually unnoticeable.

The beaded accessory 10 is held in place on the skin by adhesive 18, which is placed either on the accessory 10 or directly on skin 20. The beaded accessory 10 may be affixed to the skin 20 in any sort of pattern and in any place on the body. One recommended place to use the beaded accessory 10 is on the eyelid, just above the eyelashes, where eyeliner is typically applied. FIGS. 1–9 show just a few of the many designs that can be created and places the beaded accessory 10 can be used.

After use, the beaded accessory 10 is peeled off. Since many of the adhesives 18 become "gummy" when dry, there is no pain when the beaded accessory 10 is removed. The beaded accessory 10 is re-usable, since strands of beads 12 may be applied as many times as desired by adding new adhesive. In addition, the beaded accessory 10 is extremely personal and creative. The user may combine different strand colors, lengths and types (i.e., single strand, multi-strand, webbed) to create unique designs.

Figure 6:
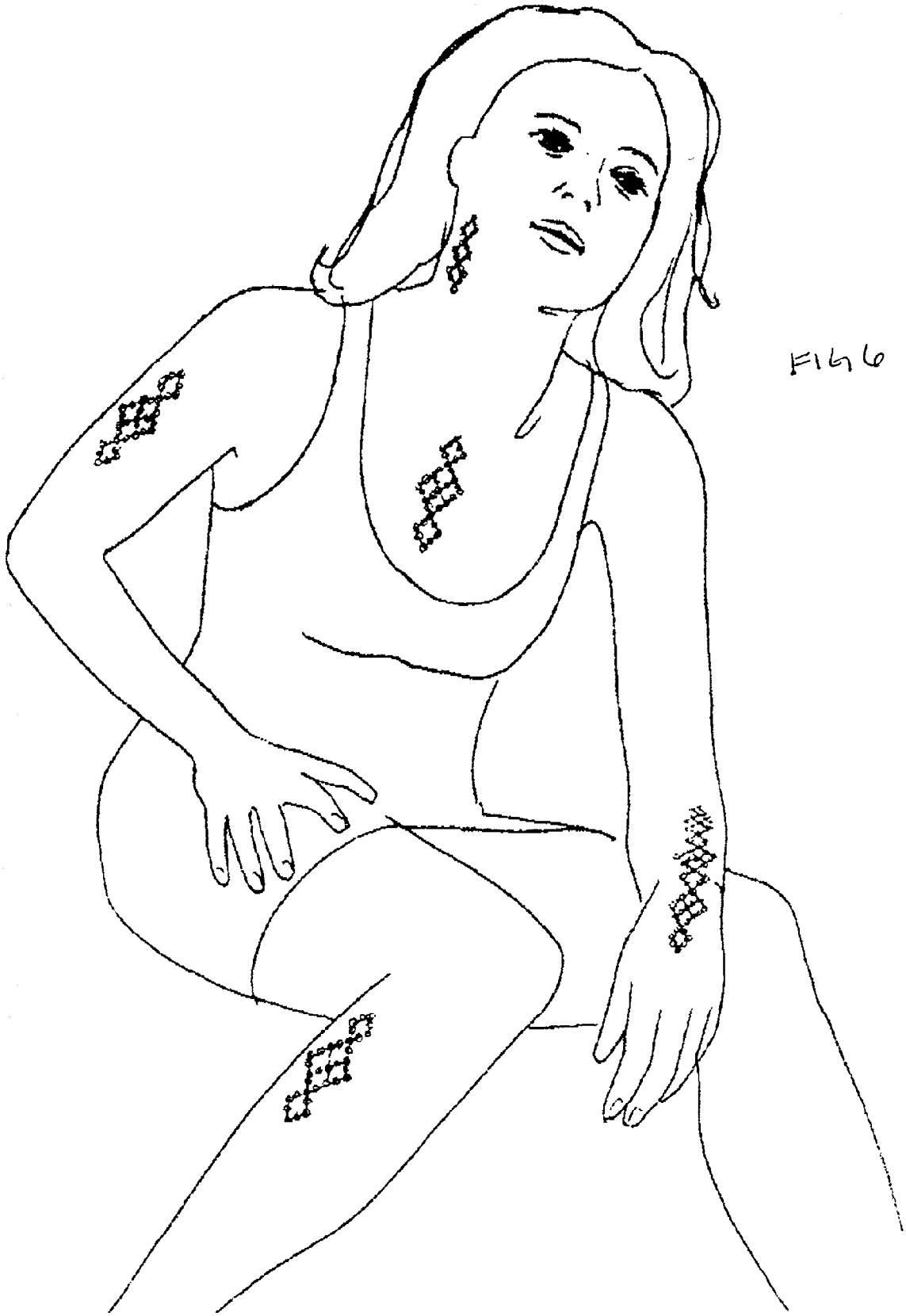
FIG. 6 is a view of a user wearing a multi-strand version of the beaded accessory on her arms, leg, chest and neck.

One variation of the invention 10 is the single strand, shown in FIGS. 1–5. A second variation is a multi-strand version, where two, three, four, etc., strands are combined in one piece, as seen in FIG. 6. A third variation is a webbed accessory, shown in FIG. 9. The webbed accessory has multiple strands of material 16 going through some or all of the beads to create a web that hold the beads in a two-dimensional array that may or may not be geometrical. A fourth variation is an appliqué version which may be worn entirely against the user's skin as seen in FIG. 7 or have flounces or other free moving parts as seen in FIG. 8.

The appliqué versions of the accessory may or may not contain beads. The appliqués may be formed of any suitable material such as fabric, foil, netting, lace, etc.

Method of Use

First, the beads are strung onto the string, either in a straight line or in a woven pattern. The strings may come pre-strung for the user, or the user may purchase a kit or parts to string her own strand. Once the strand or appliqué is ready, the adhesive is applied to the beads or appliqué and/or the skin, in the pattern desired. Depending on the adhesive used, the user may wait to allow the adhesive to dry to until it becomes tacky or the user may be able to immediately begin to apply the accessory. The strung beads or appliqué are affixed to the skin via the adhesive. For some of the adhesives, the user may be able to adjust the beads one or more times to create the desired effect.

Many features have been listed with particular configurations, options, and embodiments. Any one or more of the features described may be added to or combined with any of the other embodiments or other standard devices to create alternate combinations and embodiments.

Although the examples given include many specificities, they are intended as illustrative of only a few possible embodiments of the invention. Other embodiments and modifications will, no doubt, occur to those skilled in the art. Thus, the examples given should only be interpreted as illustrations of a few of the preferred embodiments of the invention, and the full scope of the invention should be determined by the appended claims and their legal equivalents.

What is claimed is:

1. A beaded fashion accessory for decorating the skin and body of a user, comprising:

a strand of flexible material, a plurality of beads located around said strand of material, thereby forming a strand of beads at least an inch in length, and an adhesive suitable for adhering said beads and strand of material to the skin of the user, wherein when said beaded fashion accessory is worn by the user the adhesive connects said plurality of beads directly to the skin of the user along an entire length of said strand of beads.

2. The beaded fashion accessory of claim 1, wherein said plurality of beads have holes extending therethrough and said strand of material extends through said holes.

3. The beaded fashion accessory of claim 1, wherein said strand of material is a metal wire.

4. The beaded fashion accessory of claim 1, wherein said strand of material is preformed into a design.

5. The beaded fashion accessory of claim 1, wherein said strand of beads is at least an inch in length.

6. The beaded fashion accessory of claim 1, wherein said strand of beads is at least two inches in length.

7. The beaded fashion accessory of claim 1, wherein said strand of beads is woven with additional strands of beads to form a woven pattern.

8. The beaded fashion accessory of claim 1, wherein said strand of beads is a part of a piece of fabric.

9. The beaded fashion accessory of claim 1, wherein said strand is malleable.

10. The beaded fashion accessory of claim 1, wherein said strand of beads is less than 6 inches in length.

11. The beaded fashion accessory of claim 1, wherein said strand of beads is less than 2 inches in length.

12. The beaded fashion accessory of claim 1, wherein said strand of material is string.

13. The beaded fashion accessory of claim 1, wherein the strand of material is a single piece of flexible string.

* * * * *